United States Patent [19]

England

[11] 3,946,717

[45] Mar. 30, 1976

[54] FUEL VAPORIZER WITH CENTRIFUGAL-VENTURI LIQUID DROPLET FEEDBACK

[76] Inventor: Will Clarke England, 7310 Eastcrest Drive, Austin, Tex. 78752

[22] Filed: Apr. 14, 1975

[21] Appl. No.: 567,781

[52] U.S. Cl. ..... 123/141; 261/84; 261/89; 48/180 R; 48/180 S

[51] Int. Cl.[2] ..... F02M 29/00; B01F 3/02

[58] Field of Search ..... 123/141; 261/84, 89; 48/180 R, 180 M, 180 S

[56] References Cited

UNITED STATES PATENTS

| | | | |
|---|---|---|---|
| 608,394 | 8/1898 | Moss | 48/180 S |
| 1,406,113 | 2/1922 | Van Voorhis et al. | 48/180 S |
| 1,710,299 | 4/1929 | Dean et al. | 48/180 S |
| 1,741,280 | 12/1929 | Brewer | 48/180 S |
| 2,216,722 | 10/1940 | Denson | 123/141 X |
| 2,314,170 | 3/1943 | Snyder | 261/89 X |
| 2,639,230 | 5/1953 | Le Febre | 123/141 X |

*Primary Examiner*—Charles J. Myhre
*Assistant Examiner*—Ira S. Lazarus

[57] ABSTRACT

Upon the premises that carberation does not provide for substantial vaporization of the fuel to be combusted, this invention discloses a fuel vaporizer inserted in the air and fuel passage with liquid droplet feedback via a sieve providing a venturi effect in combination with a flow driven spinning bowl providing a centrifugal liquid return to the sieve for cycling of the liquid fuel until vaporization.

10 Claims, 6 Drawing Figures

FUEL VAPORIZER WITH CENTRIFUGAL-VENTURI LIQUID DROPLET FEEDBACK

SUBJECT MATTER OF THE INVENTION

The invention relates generally to fuel savings devices and relates more specifically to fuel vaporizing apparatus which has a liquid droplet feedback system for improving carberation and combustion.

OBJECTS OF THE INVENTION

According to the more popular opinion there is a significant amount of gasoline wasted in most automobiles due to inadequate vaporization of the gasoline in the carberator. This inadequate vaporization causes the gasoline liquid droplets to burn too slowly to assist in the power stroke of any reciprocating engine. It is therefore an object of this invention to improve the vaporization of any combustible liquid and vapor.

Another object of this invention is to separate the air and fuel vapor from the liquid droplets of fuel and recycle said droplets until evaporation is substantially complete.

A further object of this invention is to utilize the flow of air and fuel vapor to power the liquid fuel feedback system, thus making said system responsive to the rate of flow.

Other objects and advantages of this invention will become apparent through consideration of the following description and appended claims in conjunction with the attached drawings in which:

Figure 1:
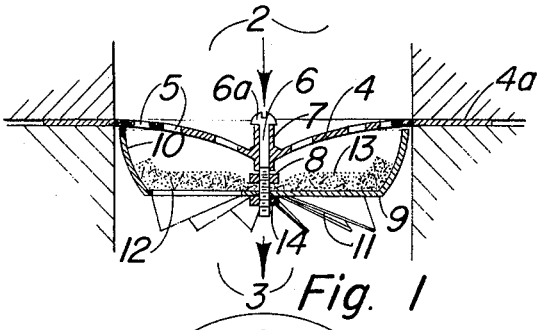
FIG. 1 is a cross-section of a fuel vaporizing device inserted in an air and fuel passage.
Figure 2:
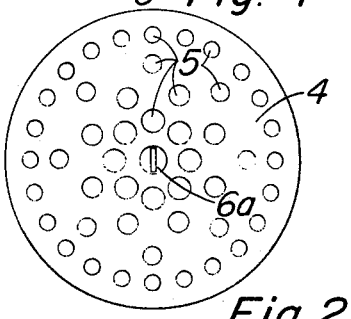
FIG. 2 is a top view of a fuel vaporizing device in the air and fuel passage.
Figure 3:
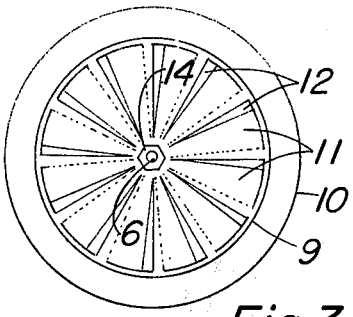
FIG. 3 is a bottom view of a fuel vaporizing device in the air and fuel passage.
Figure 4:
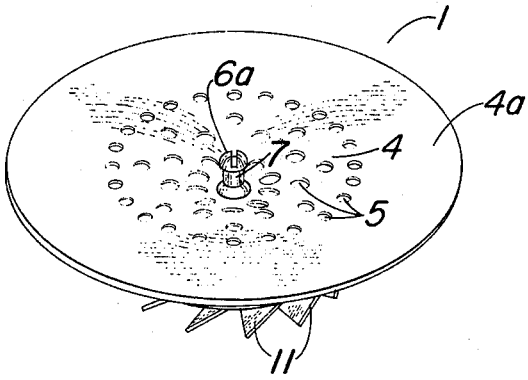
FIG. 4 is a top perspective view of a fuel vaporizing device.
Figure 5:
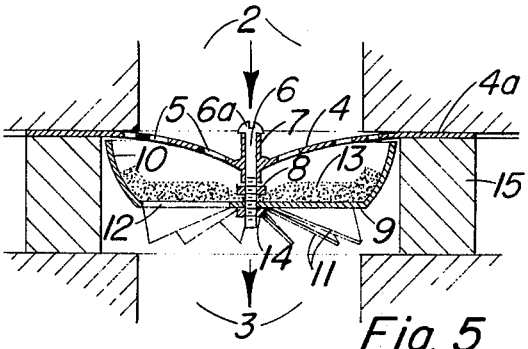
FIG. 5 is a cross-section of a fuel vaporizing device inserted in an enlargement of an air and fuel passage.
Figure 6:
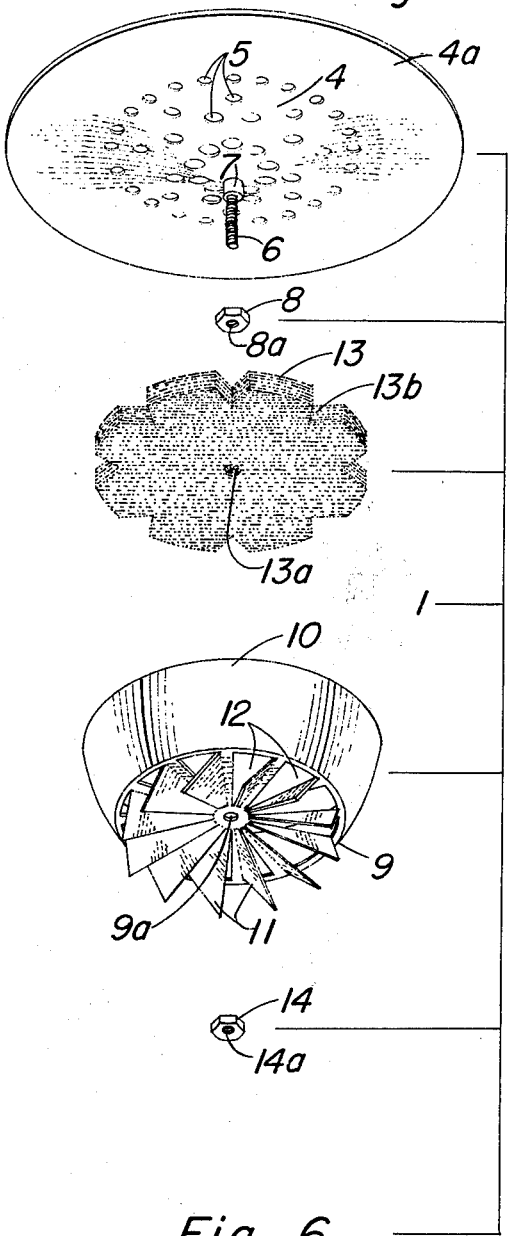
FIG. 6 is a bottom exploded perspective view of a fuel vaporizing device.

In describing one selected form of preferred embodiment of this invention as shown in the drawings and this specification, specific terms and components are used for clarity. However, it is not intended to limit the claimed invention to the specific form components, or construction shown and it is to be understood that specific terms used in this illustration of the invention are intended to include all technical equivalents which operate in a similar manner to accomplish a similar purpose.

DETAILED DESCRIPTION OF PREFERRED EMBODIMENT OF INVENTION

With reference to the patent drawings, my invention of a fuel vaporizer with centrifugal-venturi liquid droplet feedback 1 mounted in the air and fuel passage intake of a combustion engine comprises, in general: a conical shaped sieve 4 with the apex protruding in the direction of air and fuel flow; a spindle bearing 7 mounted securely in the apex of said conical shaped sieve; a spindle 6 rotatably inserted in said spindle bearing 7 and secured against movement along the axis of rotation; a centrifugal bowl 9 mounted to said spindle 6 and rotatable therewith, said centrifugal bowl 9 having openings 12 in the bottom of said bowl to allow air and fuel vapor flow with the slower fuel liquid droplets impacting on said bowl bottom and being conveyed by the bowl sides 10 to the bowl rim by centrifugal action and the backside of said conical shaped sieve 4 by the venturi effect of the air and fuel flow; and an axial impeller 11 also mounted securely to said spindle 6 and rotatable therewith, said axial impeller 11 being rotatably responsive to the air and fuel vapor flow through said fuel vaporizer 1.

The conical shaped sieve 4 being a main non-rotatable part can be easily mounted between the carberator passage 2 and the manifold intake entrance 3 by a outer mounting flange 4a attached around the outer perimeter of said sieve 4. The sieve 4 could also by other mounting means be secured in the carberator passage 2 or the manifold intake entrance 3. The sieve openings 5 could be uniform in size and spacing or could be increasing in size and/or number toward the central protuberance to amplify the naturally faster air and fuel vapor flow in the central area of the passage.

The spindle 6 rotatably mounted in the spindle bearing 7 is illustrated to be a partially threaded shaft with a spindle cap **6*a* and a spindle spacing fastener 8 having a threaded hole 8*a* utilized for restricting the spindle axial movement and another threaded hole 14*a* in the spindle fastener 14 which anchors the centrifugal bowl 9 to the spindle 6. Other methods are available in the art such as snap rings, soldering and welding to accomplish the functions of the illustrated fasteners and cap 6*a* of said spindle 6. The spindle 6 should be freely rotatable in said spindle bearing 7** with as little friction as possible while still being of such close tolerance to prevent any wobble which would allow contact between the other moving and stationary parts.

The centrifugal bowl 9 is fastened securely to said spindle 6 via the spindle hole **9*a* in the bowl bottom and rotates therewith being symetrically centered about the axis of rotation of said spindle. The spindle 6 and centrifugal bowl 9 are rotated by the air and fuel vapor flow through an axial impeller 11 securely fastened thereto. The axial impeller 11 could be a separate mechanical part fastened to said spindle before or after the conical shaped sieve 4 in the direction of flow, however, the axial impeller 11 is illustrated as being fashioned out of the openings 12 in the bottom of said centrifugal bowl, this being the most economical and functional configuration. In the event a greater driving force is necessary, multiple axial impellers 11** could be utilized.

The opening 12 in the centrifugal bowl bottom must be such as to allow the flow of the air and fuel vapor while causing the liquid fuel droplets to impact thereon. The collisions between the bowl bottom and the liquid droplets are multiplied by rotation of said bottom of the centrifugal bowl 9 at right angles to the general direction of flow of the air and fuel vapor. In the event a separate axial impeller 11 is utilized the bowl bottom openings 12 could be a sieve. When the axial impeller 11 is fashioned out of the bowl bottom it is appropriate to include a baffle filter 13 secured inside the centrifugal bowl 9. The baffle filter 13 still allows the flow of the air and fuel vapor while intensifying the impact of liquid droplets in the bowl bottom. A baffle filter 13 such as made from fiberglass mat would allow a circuitous path for the air and fuel vapor flow but the liquid fuel droplets, being of larger momentum could not turn the corners so readily and would thus impact on the rotating baffle filter 13 more readily. As illustrated said baffle filter 13 is mounted on said spindle 6 through a hole 13*a* in said baffle filter 13 and is secured to the bottom of the centrifugal bowl 9 between the spindle spacing fastener 8 and spindle fastener 14. Using a nut for the spindle fastener 14 would allow removal and replacement of the baffle filter 13. The filter cut-outs 13*b* around the perimeter of the baffle filter 13 are provided so that the filter edges may be upturned in the centrifugal bowl 9 without wrinkling.

The centrifugal bowl sides 10 are upturned so that the rim is almost in contact with the backside of the conical shaped sieve 4. As the captured liquid fuel is centrifugally forced outward by the spin of the axial impeller driven centrifugal bowl 9, the bowl sides 10 direct the liquid flow to the backside of said conical shaped sieve 4, where upon said liquid flow is directed toward the apex of the conical shaped sieve 4 by the venturi effect of the air and fuel vapor flow through said sieve.

In the event that the carberator-intake manifold throat is too small for the insertion of said fuel vaporizer 1 a carberator-manifold throat enlarger-spacer 15 could be used between the carberator and the manifold intake to contain said fuel vaporizer.

All parts of the fuel vaporizer with centrifugal-venturi liquid droplet feedback 1 could be fabricated out of metal or a rigid plastic not desolvable by the fuel. Even the baffle filter 13 could be made out of a steel or metal wool or a catalytic vapor activating material.

OPERATION

The operation of the fuel vaporizer with centrifugal-venturi liquid droplet feedback 1 is for the purpose of filtering out, containing and feeding back the liquid fuel until the liquid fuel vaporizes in the air-fuel intake passage of an internal combustion engine.

As the air and fuel vapor pass through the conical shaped sieve 4, some liquid droplets will impact on the solid portions of said sieve and then flow toward the protuberant center of said sieve because of the greater central flow. As the air and fuel vapor pass through the openings in the bottom of the centrifugal bowl 9, again the liquid droplets will impact on the solid portion of the rotating bowl 9 bottom or, if provided, on the baffle filter 13 and the liquid fuel captured thereon will be forced outward by the centrifugal action of the spinning centrifugal bowl 9. Also any liquid fuel flowing down the spindle bearing from the protuberance of the conical shaped sieve 4 will flow outward and all of said liquid fuel will be returned to the backside of said conical shaped sieve by the centrifugal bowl sides, there again to flow toward the protuberant center of the conical shaped sieve 4 on its backside. The axial impeller 11 is driven by and responsive to the flow of the air and fuel vapor and is connected to the spinning centrifugal bowl 9 to provide the centrifugal action.

The continuous recycling of the liquid fuel until it vaporizes completely would be optimum operation for the fuel vaporizer 1.

ADVANTAGES OF THE INVENTION

A material advantage of the invention is that it provides for more adequate vaporization of fuel for internal combustion.

A further advantage of the invention is the recycling of the liquid fuel until substantial vaporization occurs.

A still further advantage of the invention is that combustion of a more substantial vapor would produce less carbon monoxide.

A still further advantage of the invention is that the vaporizing action and liquid feedback is responsive to the quantitative flow of air and fuel vapor.

Although this specification described but one embodiment of the invention with certain modifications thereof, it is understood that structural or material rearrangements of adequate or equivalent parts, substitution of equivalent parts and other modifications in structure can be made and other applications devised without departing from the scope of my invention. I therefore desire that the description and drawings herein be regarded as only an illustration of my invention and that the invention be regarded as limited only as set forth in the following claims, or as required by the prior art.

Having thus described my invention, I claim:

1. A centrifugal-venturi liquid droplet feedback fuel vaporizer inserted in the passage of fuel and air flow between the place of fuel mist introduction and a combustion chamber intake comprising:

A. a sieve mounted across the flow passage with a protuberant center extending in the direction of flow whereby the air and fuel vapor would accelerate through said seive openings and the slower liquid fuel droplets would tend to impact on said sieve face and flow toward the protuberant center because of differential flow characteristics;

B. a spindle bearing mounted securely in the protuberant center of said sieve;

C. a spindle rotatably installed in said spindle bearing, the axis of rotation corresponding to the direction of flow, and said spindle secured in said spindle bearing against movement along the axis of rotation;

D. a circular bowl with a rim nearly touching the backside of said sieve, and said rim outside of said sieve openings mounted securely to said spindle in the center of the bottom of said bowl after said sieve in the direction of flow with said bowl being free to rotate symetrically with said spindle;

1. the bottom of said bowl having openings allowing the accelerated flow through said openings of the air and fuel vapor with said slower liquid fuel droplets again tending to impact on the bowl bottom due to the rotation of bowl bottom openings at right angles to the general direction of air and fuel vapor flow, with said impacted liquid fuel centrifugally spun outward in said bowl;

2. the circular sides of said bowl directing the outward liquid flow back to the outer perimeter of the back side of said sieve, there again to flow toward the protuberant center of said sieve because of differential pressure; and E. an axial impeller centrally secured to said spindle and rotatable therewith, said impeller rotatably responsive to said air and fuel flow, thus rotating said circular bowl.

2. The centrifugal-venturi liquid droplet feedback fuel vaporizer described in claim 1 with said sieve provided with a flat mounting flange around the outer perimeter of said sieve for mounting the apparatus between the outlet passage of a carberator and the face of an intake manifold.

3. In a fuel vaporizer apparatus according to claim 1, said sieve openings increasing in size toward said protuberant center to increase the differential flow of air and fuel vapor between said sieve perimeter and said protuberant center.

4. The centrifugal-venturi liquid droplet feedback fuel vaporizer described in claim 1 further provided with a baffle filter secured in said circular bowl bottom, said filter being of such porousity to allow passage of the air and fuel vapor flow with said slower liquid fuel droplets tending to impact with the filter baffles, said impacts further increased by the rotation of said baffle filter at right angles to the general direction of flow of air and fuel vapor.

5. In a fuel vaporizer apparatus according to claim 1, said axial impeller being fashioned out of the circular bowl bottom openings.

6. The centrifugal-venturi liquid droplet feedback fuel vaporizer described in claim 2 provided with a passage enlargement insert when the apparatus is too large for a given air and fuel passage.

7. The centrifugal-venturi liquid droplet feedback fuel vaporizer described in claim 3 provided with a baffle filter secured in said circular bowl bottom.

8. The centrifugal-venturi liquid droplet feedback fuel vaporizer described in claim 5 provided with a baffle filter secured in said circular bowl bottom.

9. In a fuel vaporizer apparatus according to claim 7, said axial impeller being fashioned out of the circular bowl bottom openings.

10. The centrifugal-venturi liquid droplet feedback fuel vaporizer described in claim 9 with said sieve provided with a flat mounting flange around the outer perimeter of said sieve for mounting the apparatus between the outlet passage of a carberator and the face of an intake manifold.

* * * * *